United States Patent [19]

Arai

[11] Patent Number: 4,508,960

[45] Date of Patent: Apr. 2, 1985

[54] LIGHT-RADIANT FURNACE

[75] Inventor: Tetsuji Arai, Tachikawa, Japan

[73] Assignee: Ushio Denki Kabushiki Kaisha, Tokyo, Japan

[21] Appl. No.: 527,474

[22] Filed: Aug. 29, 1983

[30] Foreign Application Priority Data

Aug. 30, 1982 [JP] Japan ..... 57-149055

[51] Int. Cl.[3] ..... F27B 9/06; H05B 1/02

[52] U.S. Cl. ..... 219/388; 219/405; 219/411; 118/724

[58] Field of Search ..... 219/388, 405, 411, 354, 219/390, 85 BA, 85 BM; 432/148; 118/50.1, 724, 725, 728

[56] References Cited

U.S. PATENT DOCUMENTS 4,180,721 12/1979 Watanabe ..... 219/388
4,221,956 9/1980 Fielding ..... 219/405
4,400,612 8/1983 Lee ..... 219/405

*Primary Examiner*—Roy N. Envall, Jr.

*Assistant Examiner*—Teresa J. Walberg

*Attorney, Agent, or Firm*—Ziems, Walter & Shannon

[57] ABSTRACT

Disclosed herein is a method for operating a light-radiant furnace equipped with incandescent lamps as the light-radiant source thereof. The method includes a step of transporting a plurality of objects successively into the light-radiant furnace and controlling the operation of the incandescent lamps in synchronization with the transportation of each of the objects into the light-radiant furnace and in accordance with a predetermined operation curve so as to expose the object to light for their heating. The method features feeding a small current to the incandescent lamps so as to dim the incandescent lamps prior to each operation of the incandescent lamps in accordance with the operation curve. According to the above method, a heat treatment of object can be repeatedly carried out always under the same conditions while enjoying rated long service life of incandescent lamps without increasing the electric power to be wasted by the incandescent lamps.

1 Claim, 8 Drawing Figures

LIGHT-RADIANT FURNACE

BACKGROUND OF THE INVENTION

1. Field of the Invention

This invention relates to a method for operating a light-radiant furnace which uses incandescent lamps as its light-radiant source.

2. Description of the Prior Art

Among a variety of apparatus adapted to carry out heat treatments therein, light-radiant furnaces in which light radiated from an incandescent lamp or lamps is irradiated onto objects or materials to be treated (hereinafter referred to merely as "objects") for their heat treatment have the following merits:

(1) Owing to an extremely small heat capacity of an incandescent lamp per se, it is possible to raise or lower the heating temperature promptly;

(2) The heating temperature can be easily controlled by controlling the electric power to be fed to the incandescent lamp;

(3) Since they feature indirect heating by virtue of light radiated from their incandescent lamps which are not brought into contact with the objects, there is little danger of contaminating objects under heat treatment;

(4) They enjoy less energy consumption because full-radiation-state operations of the lamps are feasible in short time periods after turning the lamps on and the energy efficiencies of the lamps are high; and (5) They are relatively small in size and inexpensive compared with conventional resistive furnaces or high-frequency heating furnaces.

Such light-radiant heating furnaces have been used for the heat treatment and drying of steel materials and the like and the molding of plastics as well as in thermal characteristics testing apparatus and the like. Use of light-radiant furnaces have, particularly recently, been contemplated to replace the conventionally-employed resistive furnaces and high-frequency heating furnaces for carrying out certain semiconductor fabrication processes which require heating, for example, diffusion processes of dopant atoms, chemical vapor deposition processes, healing processes for crystal defects in ion-implanted layers, thermal treatment processes for electrical activation, and thermal processes for nitrifying or oxidizing the surfaces of silicon wafers. As reasons for the above move, may be mentioned the incapability of conventional heating furnaces for use in the uniform heating of larger-sized objects, thereby failing to meet the recent trend toward larger semiconductor wafer size. In addition to such advantages of light-radiant furnaces that objects under heat treatment are free from contamination, their electric properties are not deleteriously affected and the light-radiant heating furnaces require less power consumption.

In such a light-radiant furnace, there is provided a suitable conveyor system for transporting objects. By the conveyor system, each object is transported into the light-radiant furnace and then subjected to a heat treatment therein. Namely, each object is held on a carrier of the conveyor system at the loading station of objects. Thereafter, the carrier is caused to move in the light-radiant furnace in which the object held on the carrier is exposed to light radiated from the incandescent lamps so as to carry out the heat treatment. Then, the carrier is again caused to move to the unloading station of treated objects, which unloading station is located outside the light-radiant furnace. At the unloading station, the thus-treated object is unloaded from the carrier, thereby completing a single cycle of the heat treatment process. The carrier is thereafter moved again to the loading station and loaded with the next object to be treated. Then, the heat treatment process of the next object is carried out in the same manner.

Heat treatment of objects are generally carried out in such a manner as mentioned above. Depending on the kinds or types of objects to be treated, their heating temperatures and heating time periods must be strictly controlled. Accordingly, objects of the same kind or type must be heat-treated under the exactly same conditions.

To achieve such a heat treatment, it may for example be contemplated to keep incandescent lamps used as the light-radiant source such as halogen incandescent lamps on lighting with a constant power so as to make the radiated light energy constant in the light-radiant furnace and, while maintaining the above state, to hold each object for a predetermined constant period of time in the light-radiant furnace for its heat treatment. This method is however accompanied by a drawback that the electric power is significantly wasted, because the incandescent lamps are continuously lit with the same electric power as that supplied while effecting the heat treatment of an object even when no object is present in the light-radiant furnace, in other words, during the waiting period.

It may also be contemplated, for saving the power consumption, to light the incandescent lamps with a constant power and for a predetermined time period after transportation of each object into the light-radiant furnace so as to carry out the heat treatment of the object for the predetermined time period and to keep the incandescent lamps off during any periods other than heat treatment periods. This method is however accompanied by such shortcomings as will be mentioned below.

In an incandescent lamp, the filament coil contains some parts where the diameter of the filament is smaller than the remaining parts thereof due to non-uniformity in diameter of the starting filament. Furthermore, the filament of the filament coil becomes thinner at certain parts thereof in the course of its use due to uneven vaporization of the metal making up the filament coil, which uneven vaporization is caused by irregularity of the coil pitch of the filament coil, local non-uniformity of the halogen cycle if the incandescent lamp is a halogen incandescent lamp, or other causes. When using incandescent lamps by repeatedly turning them on and off many times in order for example to subject a number of objects to heat treatment successively, there is a big difference between the resistance of the filament coil of each incandescent lamp prior to turning it on and that during the full-radiation-state operation thereof. Thus, a rush current as large as several times (about 7–12 times) the current supplied during the full-radiation-state operation is caused to flow through the filament coil at every time of turning on, thereby making the filament coil hotter at smaller-diametered parts than the remaining parts thereof and accelerating vaporization of the metal at the smaller-diametered parts. Accordingly, the filament coil is eventually burnt out at one of the smaller-diametered parts, thereby shortening service life of the lamp. This means that such incandescent lamps have to be replaced by fresh incandescent lamps rather often, resulting in a high running cost of the light-radiant furnace from the long-term viewpoint.

SUMMARY OF THE INVENTION

The present invention has been completed with the foregoing in view and has, as its object, the provision of an operation method of a light-radiant furnace equipped with incandescent lamps as its light-radiant source, which method permits to conduct heat treatment of objects repeatedly and always under the exactly same conditions and can prevent shortening the service life of the incandescent lamps without increasing the electric power wasted by the incandescent lamps.

In one aspect of this invention, there is thus provided a method for operating a light-radiant furnace equipped with incandescent lamps as the light-radiant source thereof, said method including a step of transporting a plurality of objects successively into the light-radiant furnace and controlling the operation of the incandescent lamps in synchronization with the transportation of each of the objects into the light-radiant furnace and in accordance with a predetermined operation curve so as to expose the object to light for its heating, which method comprises feeding a small current to the incandescent lamps so as to dim the incandescent lamps prior to each operation of the incandescent lamps in accordance with the operation curve.

According to the present invention, a heat treatment of an object can be repeatedly carried out always under the same conditions while enjoying rated long service life of incandescent lamps as the light-radiant source without increasing the electric power to be wasted by the incandescent lamps.

The above and other objects, features and advantages of the present invention will become apparent from the following description and the appended claim, taken in conjunction with the accompanying drawings.

DETAILED DESCRIPTION OF THE INVENTION

Figure 1:
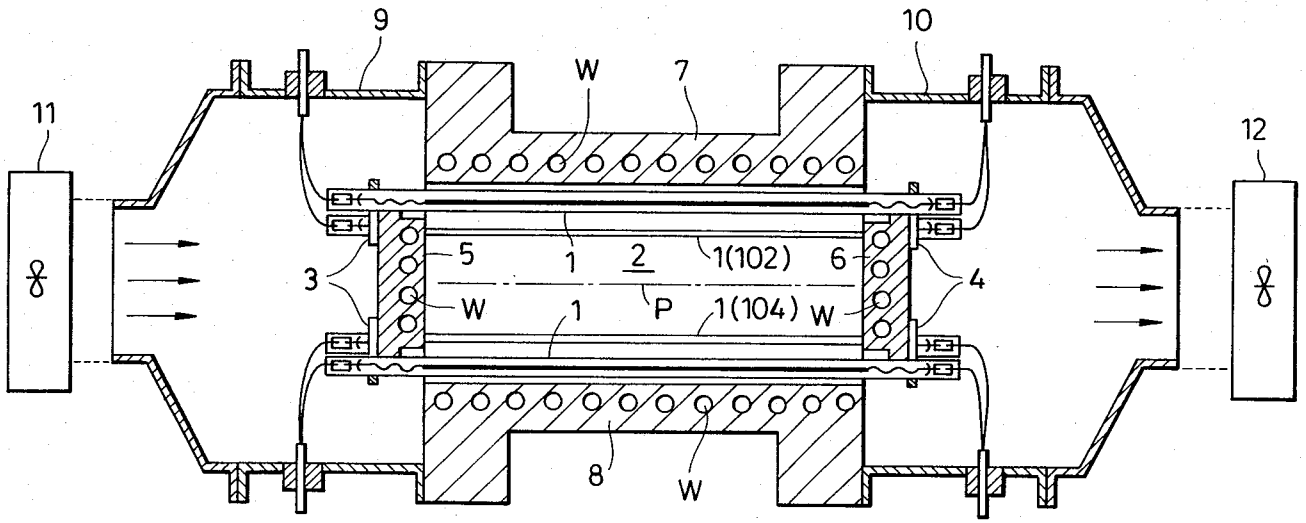
FIG. 1 is a simplified, schematic, longitudinal, cross-sectional view of a light-radiant furnace, to which the method of this invention may be applied.
Figure 2:
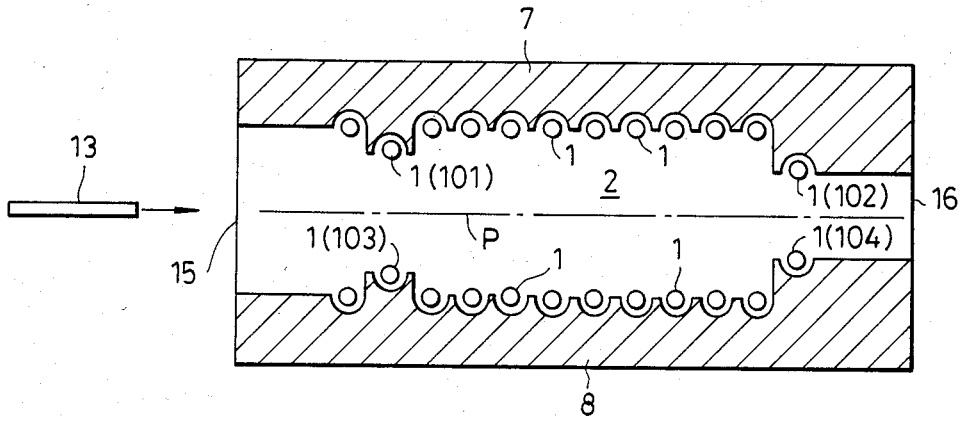
FIG. 2 is a simplified, schematic, transverse, cross-sectional view of the light-radiant furnace, showing the arrangement of incandescent lamps and mirrors in detail.

FIGS. 1 and 2 illustrate one example of light-radiant furnaces useful in the practice of this invention. Numeral 1 indicates incandescent lamps such as, for example, halogen incandescent lamps arranged respectively above and below an irradiation space 2 and extending in one direction (in the left-to-right direction in FIG. 1). Twelve incandescent lamps 1 are provided side by side above the irradiation space 2 and additional twelve incandescent lamps 1 are also provided side by side below the irradiation space 2. Among these incandescent lamps 1, incandescent lamps 101, 102, 103, 104 which are respectively disposed near both ends of the light-radiant furnace are provided at levels different from the other incandescent lamps so that the former lamps are closer to the level P at which an object is held in the irradiation space 2. Designated at numerals 3,4 are holders for supporting the incandescent lamps 1. These holders 3,4 are in turn fixed on their corresponding side mirrors 5,6 which will be described later.

Numeral 7,8 are main mirrors provided behind their corresponding incandescent lamps 1, while the side mirrors 5,6 cover up both sides of the irradiation space 2 respectively. Water conduits W are formed through the wall of each of the main mirrors 7,8 and the side mirrors 5,6 so as to cause cooling water to flow therethrough.

Designated at numeral 9,10 are air duct members connected respectively to the longitudinally-outer surfaces of the main mirrors 7,8. An air blower 11 is coupled with one of the air duct members, i.e., the air duct member 9 while an exhaust fan 12 is connected to the other air duct member 10. As shown by arrows in FIG. 1, cooling air is blown from the air blower 11. The cooling air is then caused to flow along the sealed tubes of the incandescent lamps 1 while cooling the sealed tubes and mirrors, and reaches the exhaust fan 12.

Figure 3:
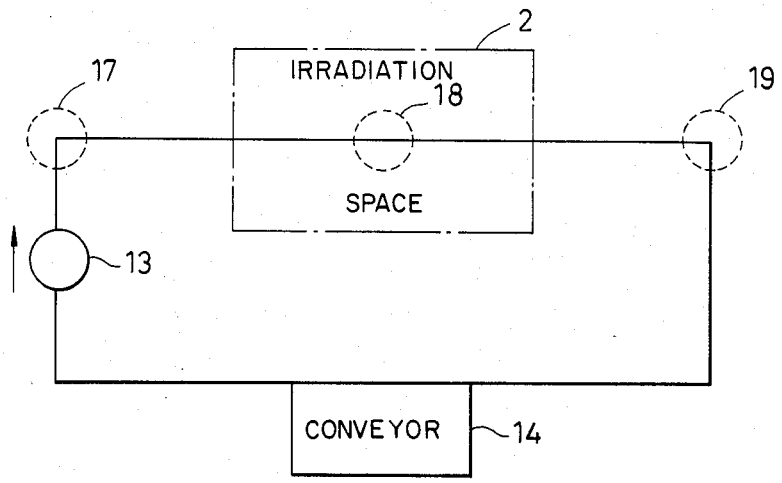
FIG. 3 is a diagram of a conveyor system.

Numeral 13 (see FIG. 2) indicates a carrier table on which an object is to be held for its treatment. This carrier table 13 is conveyed, for example, by a conveyor system 14 as shown in FIG. 3, from a loading station 17 where the carrier table 13 receives an untreated object, moved into the light-radiant furnace through one of openings 15, 16 (see FIG. 2) in a direction perpendicular to the sheet of FIG. 1, for example, the opening 15, stopped for a predetermined time period at a treatment position 18 along the level P at which each object is held in the irradiation space 2 of the light-radiant furnace, and thereafter conveyed out through the other opening 16. The thus-conveyed out carrier table 13 travels via an unloading station 19, where the thus-treated object is unloaded and transferred, again to the initial loading position 17, thereby completing a single cycle of transportation. The same transportation cycle is repeatedly carried out whenever objects are subjected to the heat treatment.

In one embodiment of this invention, the light-radiant furnace of the above structure is operated in the following manner. First of all, an object is held on the carrier table 13 at the loading station 17. The carrier table 13 is then brought into the light-radiant furnace and stopped for a predetermined time period at the treatment position 18 in the irradiation space 2. This time period, during which the carrier table 13 is stopped, should be set equal to or somewhat longer than the time period required to expose the object to light for its heat treatment. The latter time period will be described later. On the other hand, the incandescent lamps 1 are dimmed by feeding a small current thereto when an object has been held on the carrier table 13, the carrier table 13 with the object held thereon has started moving from the loading station 17 or the carrier table 13 has passed through one of the openings, i.e., the opening 15 and has been brought into the light-radiant furnace, in other words, at least prior to each of repeated heating steps of objects in which steps the incandescent lamps are operated in accordance with a prescribed operation curve so as to expose the objects to light for their heating as will be described later. Thereafter, the incandescent lamps 1 are operated in accordance with the prescribed operation curve into a full radiation state in synchronization with each transportation of the carrier table 13 into the light-radiant furnace, for example, from a time point that the carrier table 13 has stopped at the treatment position 18 in the irradiation space 2. The object on the carrier table 13, which has been brought to the treatment position 18, is heat-treated by its exposure to light from the incandescent lamps 1 operated in the full-radiation-state for a time period determined by the above-referred to operation curve.

Figure 4:
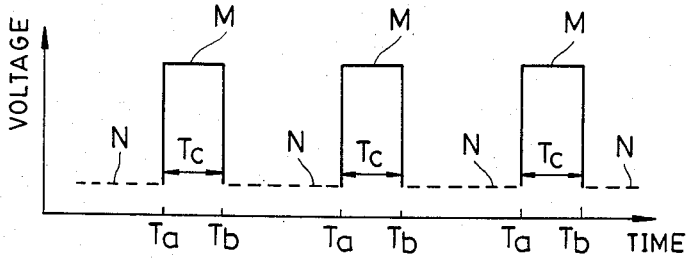
FIGS. 4 to 7 are respectively diagrams showing operation curves in full-radiation-state operations of incandescent lamps and voltage curves in dimming operations of the incandescent lamps by way of example.
Figure 5:
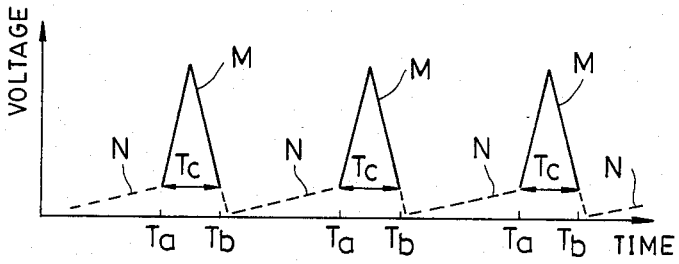
Figure 6:
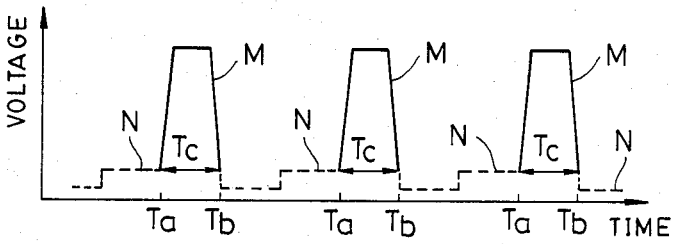
Figure 7:
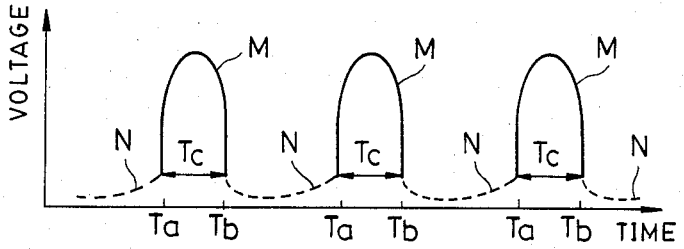

Here, the operation curve M may be represented for example by a curve showing changes in voltage to be applied to the incandescent lamps 1 as a function of time. Examples of such a curve include a square wave drawn (by a solid line) in FIG. 4, a triangular wave shown (by a solid line) in FIG. 5, trapezoidal wave given (by a solid line) in FIG. 6, a wave drawn (by a solid line) as shown in FIG. 7, etc. In these diagrams, Ta and Tb indicate respectively the starting time points and ending time points of the operation curves in each heat treatment step. The time interval Tc, which spans from the starting time point Ta to the ending time point Tb on each operation curve is determined by the time required for the heat treatment of each object. In each heat treatment step, the incandescent lamps 1 are brought into the full-radiation-state operation in accordance with exactly the same operation curve. Letter N indicates a voltage curve (drawn by a broken line) of a voltage applied to the incandescent lamps 1 when feeding a small current to the incandescent lamps 1 for their dimming. In FIG. 4, the voltage remains constant during each dimming of the incandescent lamps 1. In FIG. 5, the voltage increases linearly in each dimming time period. The voltage increases stepwise in each dimming time period in FIG. 6. In FIG. 7, the voltage increases curvilinearly in each dimming time period of the incandescent lamps 1. The actual waveform of the voltage curve N during each dimming of the incandescent lamps 1 and that of the above-described operation curve M may be suitably selected and combined together besides the examples shown in FIGS. 4 to 7.

The magnitude of the small current to be fed to the incandescent lamps 1 during each dimming time period may be determined, for example, on the basis of the magnitude of the current supplied to the incandescent lamps during the full-radiation-state operation thereof. It is preferable to set the magnitude of the small current in such a manner that the magnitude of rush current, which flows when changing from the dimming to the full-radiation-state lighting, is limited below about 4 times the current which flows in each full-radiation-state operation of the incandescent lamps 1. More specifically, the temperature of the filament coil of each incandescent lamp 1 becomes as high as 2,500° K or so in the full-radiation-state operation thereof where the filament coil is made of tungsten. It is thus preferable to feed the small current in such a way that, taking the temperature coefficient of the resistance of tungsten into consideration, the temperature of the filament coil ranges from about 800° K to about 1,100° K in the dimming period.

Figure 8:
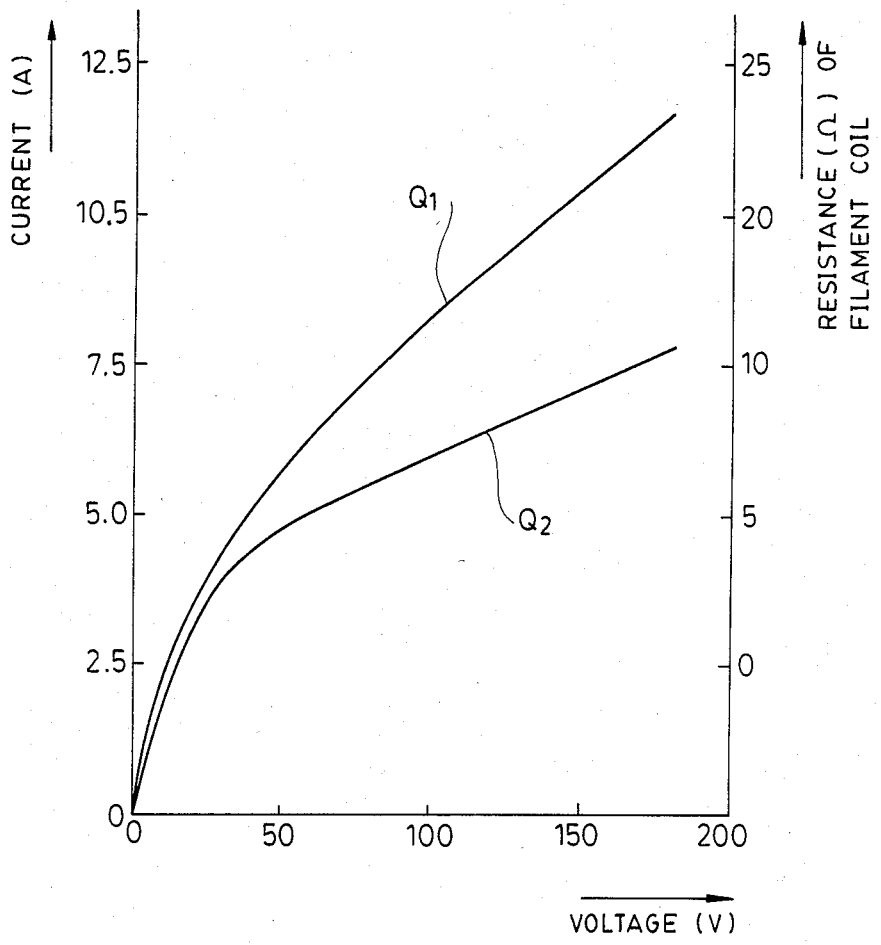
FIG. 8 is a curvilinear diagram showing the voltage/-current characteristics of a halogen incandescent lamps and the resistance characteristics of the filament coil of the incandescent lamp.

This will be discussed more specifically. When operating a light-radiant furnace equipped with halogen incandescent lamps (rated power consumption: 2,150 W), which contain filament coils each having for example the voltage/current characteristics represented by the curve $Q_1$ and the resistance characteristics represented by the curve $Q_2$ in FIG. 8, in a full-radiation-state in accordance with an operation curve M (peak voltage: 180 V) indicated by the square wave shown in FIG. 4, a current of about 11.7 A is allowed to flow in the full-radiation-state operation and the resistance of each filament coil is thus about 15.4Ω. Accordingly, the magnitude of a voltage to be applied to the incandescent lamps in order to feed a small current to the incandescent lamps and to dim the lamps prior to the full-radiation-state operation may be determined in such a way that the resistance of each filament coil becomes at least about $\frac{1}{4}$ (about 3.84Ω) of its resistance (about 15.4Ω) in the full-radiation-state operation (in this case, the voltage is about 10.5 V). When feeding the small current at such a voltage as mentioned above to dim the incandescent lamps, the magnitude of a rush current may be kept as low as 46.8 (180÷3.84)A or so even if the peak voltage (180 V) of the operation curve M is applied momentarily when changing from the dimming operation to the full-radiation-state operation. This means that the rush current is limited to as low as 4 times the current (11.7 A) flown in the full-radiation-state operation.

In the above description, the term "full-radiation-state" means a state in which the incandescent lamps are lit with a luminous output predetermined for a prescribed heat treatment. Accordingly, the term "full-radiation-state" does not necessarily mean that the incandescent lamps 1 are lit with their rated electric power.

After completion of such a heat treatment, the carrier table 13 is conveyed out of the light-radiant furnace, and the object, which has been heat-treated, is unloaded at the unloading station 19. Thereafter, the carrier table 13 is conveyed to the initial loading position 17. After completion of the heat treatment process of one object in the above manner, the next object is then loaded and held on the carrier table 13 at the loading station 17 and is thereafter heat-treated in exactly the same manner as described above.

The incandescent lamps may be either kept dimming or turned off temporarily after completion of operation of the incandescent lamps in accordance with the above-described operation curve and until establishment of a dimming state in the next heat treatment process.

According to the above-described operation method, the incandescent lamps 1 are always operated in accordance with a uniform operation curve in each heat treatment process of an object. This permits to make the state of light radiation of the incandescent lamps 1 in the light-radiant furnace constant in the heat treatment of each object, thereby ensuring to conduct the heat treatment of each object always under the exactly same conditions. As a result, the heat-treated objects have the same quality. In other words, the heat treatment can be carried out with a high level of reliability. Since the incandescent lamps 1 are dimmed by feeding a small current to them prior to operating the incandescent lamps 1 in accordance with a predetermined operation curve so as to achieve the full-radiation-state, the temperature of the filament coils of the incandescent lamps 1 are maintained at relatively higher levels in the dimming state and the resistances of the filament coils are kept greater compared with those developed while the incandescent lamps 1 are kept off. Therefore, the rush current which flows when changing the incandescent lamps 1 from the dimming state to the full-radiation-state is controlled small. Thus, the thinning of each filament coil can be minimized even if its filament includes some smaller-diametered portions, because the extents of temperature increases at such smaller-diametered portions are maintained not excessively higher than the remaining portions of the filament even if the coil temperature becomes higher at the former portions than the latter portions. As a result, the service life of each incandescent lamp would not be shortened. The operation method according to this invention can also avoid waste of electric power because the incandescent lamps 1 are operated in a full-radiation-state only while objects are subjected to a heat treatment. It should be borne in mind that the operation method according to this invention requires a dimming period in order to prevent shortening the service life of the incandescent lamps but the dimming of the incandescent lamps requires only a small power consumption.

Incidentally, halogen incandescent lamps of rated power consumption of 2,150 W (rated voltage: 180 V; rated current: 12 A) have a service life of about 2,000 hours (service life: a period before the brightness becomes about 95% of the initial brightness) when installed in a light-radiant furnace and continuously lit at the rated voltage and current. If the incandescent lamps are operated in the same light-radiant furnace but under different lighting conditions, for example, by alternating their lighting for 10 seconds at the rated voltage and current and subsequent their full turning-off for 15 seconds, their service life is significantly shortened and their filament coils are burnt out about 1,000 to 1,500 hours later. If the incandescent lamps are operated in the same light-radiant furnace in accordance with the method of this invention, for example, by alternating their lighting for 10 seconds at the rated voltage and current and subsequent their dimming, in which is flowed a current about $\frac{1}{4}$ of the rated current, for 15 seconds, their service life is about 2,000 hours which is comparable with that available when the incandescent lamps are lit continuously, thereby avoiding reduction in service life.

In the light-radiant furnace used in the above embodiment, the conveyor system is used to cause the carrier table 13 to travel from one of the openings, i.e., the opening 15 to the other opening, i.e., the opening 16. Alternatively, it is feasible to convey the carrier table 13 into and out of the light-radiant furnace through either one of the openings only.

Having now fully described the invention, it will be apparent to one of ordinary skill in the art that many changes and modifications can be made thereto without departing from the spirit or scope of the invention as set forth herein.

What is claimed is:

1. A method for heating semiconductor wafers by a light-radiant furnace equipped with, as the light-radiant source thereof, incandescent lamps having filaments subject to burning out as a result of a rush current substantially greater than a current of a full-radiation-state operation of said incandescent lamps, said method comprising:

transporting a plurality of said semiconductor wafers successively into the light-radiant furnace;

controlling operation of the incandescent lamps so that the incandescent lamps are brought into heating operation in synchronization with the transportation of each of said semiconductor wafers into the light-radiant furnace and are operated in accordance with a predetermined heating operation curve including said full-radiation-state operation to expose each said semiconductor wafer to light for its heating; and limiting the flow of said rush current through the incandescent lamps by feeding a small current to said lamps so as to provide dim operation of said lamps prior to each said heating operation of the incandescent lamps in accordance with the heating operation curve.

* * * * *